United States Patent [19]

Frobose

[11] Patent Number: 4,671,567

[45] Date of Patent: Jun. 9, 1987

[54] UPHOLSTERED CLEAN ROOM SEAT

[75] Inventor: James W. Frobose, Haskins, Ohio

[73] Assignee: The Jasper Corporation, Haskins, Ohio

[21] Appl. No.: 881,612

[22] Filed: Jul. 3, 1986

[51] Int. Cl.[4] ..... A47C 7/72

[52] U.S. Cl. ..... 297/180; 297/452; 297/DIG. 3

[58] Field of Search ..... 297/180, 452, 214, DIG. 1, 297/DIG. 2, DIG. 3, DIG. 8, 455, 461; 5/468, 440, 473

[56] References Cited

U.S. PATENT DOCUMENTS

| | | | |
|---|---|---|---|
| 2,713,892 | 7/1955 | Knapp | 297/DIG. 1 |
| 3,792,501 | 2/1974 | Kery | 297/DIG. 3 |
| 4,264,657 | 5/1980 | Graham | 297/DIG. 3 |
| 4,445,241 | 5/1984 | Ender | 5/468 |

FOREIGN PATENT DOCUMENTS

| | | | |
|---|---|---|---|
| 2201023 | 8/1973 | Fed. Rep. of Germany | 297/455 |
| 491245 | 8/1938 | United Kingdom | 292/461 |

*Primary Examiner*—James T. McCall

*Attorney, Agent, or Firm*—Brady, O'Boyle & Gates

[57] ABSTRACT

To assist in complying with strict Federal standards of cleanliness for industrial clean rooms, a sealed upholstered seat is placed in communication with an underlying relatively shallow breather bag which is retained by a seat pan attached to a rigid panel of the seat. The breather bag receives air from the upholstered seat when the seat is compressed and returns the same air to the seat as the seat expands. The escape of particulate matter from the seat into the atmosphere during usage of the seat is eliminated. A seat standard is received through an opening in the pan and passes between two spaced portions of the breather bag. The top of the standard is welded between the side walls of a channel member having side flanges which are attached to the bottom of the seat panel.

11 Claims, 4 Drawing Figures

UPHOLSTERED CLEAN ROOM SEAT

BAKCGROUND OF THE INVENTION

1. Technical Field

The present invention relates to improvements in upholstered furniture for industrial clean rooms and more particularly relates to a clean room seat having a breathing bag disposed in a relatively shallow space between a sealed upholstered seat and an underlying pan attached to the bottom of the seat and containing and supporting the breather bag.

2. The Prior Art

Prior U.S. Pat. No. 4,573,740, Frobose, discloses an upholstered clean room seat capable of meeting extremely stringent Federal standards which define the cleanliness requirements for industrial clean rooms in terms of the number of particles and the size of particles allowed per cubic foot of air in the clean room. The patent discloses the placement of a vertical elongated expandable and contractable bellows-type vessel in communication with the interior of a sealed upholstered seat having a rigid bottom panel. The bellows-type vessel has its vertical axis offset from the central pedestal of the chair. During normal compression and expansion of the upholstered seat, air and any particulate matter contained in the air within the sealed seat cushion is forced into the expandable bellows-type vessel during compression of the seat cushion and is returned from the vessel to the interior of the seat cushion when the load on the seat cushion is removed and the cushion expands to its normal shape.

The construction disclosed in the prior patent is effective for maintaining the high degree of cleanliness in clean rooms required by the applicable Federal standards but possesses some drawbacks which are eliminated by the present invention. The vertical axis bellows-type breathing vessel in the prior patent is a bit awkward and somewhat unsightly because of its off-center position on the bottom of the seat and because its length, when expanded, is quite distant from the bottom of the seat, rendering it possible for the feet and legs of the seat occupant to be contacted by the bellows-type vessel.

For these and other reasons, the present invention has for its objective the provision of a clean room seat possessing all of the capabilities of the prior patented structure in terms of cleanliness of the clean room atmosphere, and also being structured in a more compact, symmetrical and generally more aesthetically attractive manner than the patented structure.

A more specific object of the invention is to provide a clean room seat in which the prior art slender, vertically elongated, bellows-type expansion vessel is replaced by a comparatively shallow breather bag which extends over the major portion of the area of the bottom of the upholstered seat and is confined and supported by a pan attached to the bottom of the seat which pan also conceals the breather bag so as to form a neat and attractive shallow seat structure.

Still another object of the invention is to provide a clean room seat having an enclosed breather bag which is protected from abrasion and other damage by the pan which supports and conceals it beneath the upholstered seat.

A further object of the invention is to provide an industrial clean room seat which meets existing Federal standards allowing 100 particles of 0.5 micron size or smaller per cubic foot of clean room air, and also meets or exceeds anticipated stricter future standards which will allow only 10 particles of 0.5 micron size per cubic foot of clean room air.

SUMMARY OF THE INVENTION

The invention is best summarized as a sealed upholstered clean room seat having a rigid bottom panel attached to a standard forming part of a seat pedestal structure. A shallow pan beneath and attached to the rigid panel forms an enclosure and support for a breather bag which spans a major portion of the area of the seat and is equipped in its top wall with a rubber connector sleeve which interlocks with a rubber grommet engaged in an opening of the rigid panel to provide a self-sealing connection between the breather bag and upholstered seat, whereby air confined within the seat can enter the breather bag as the seat is compressed and can return from the breather bag into the seat as the seat expands, all without any leakage of air to the surrounding atmosphere.

DETAILED DESCRIPTION

Figures 1, 2, 3:
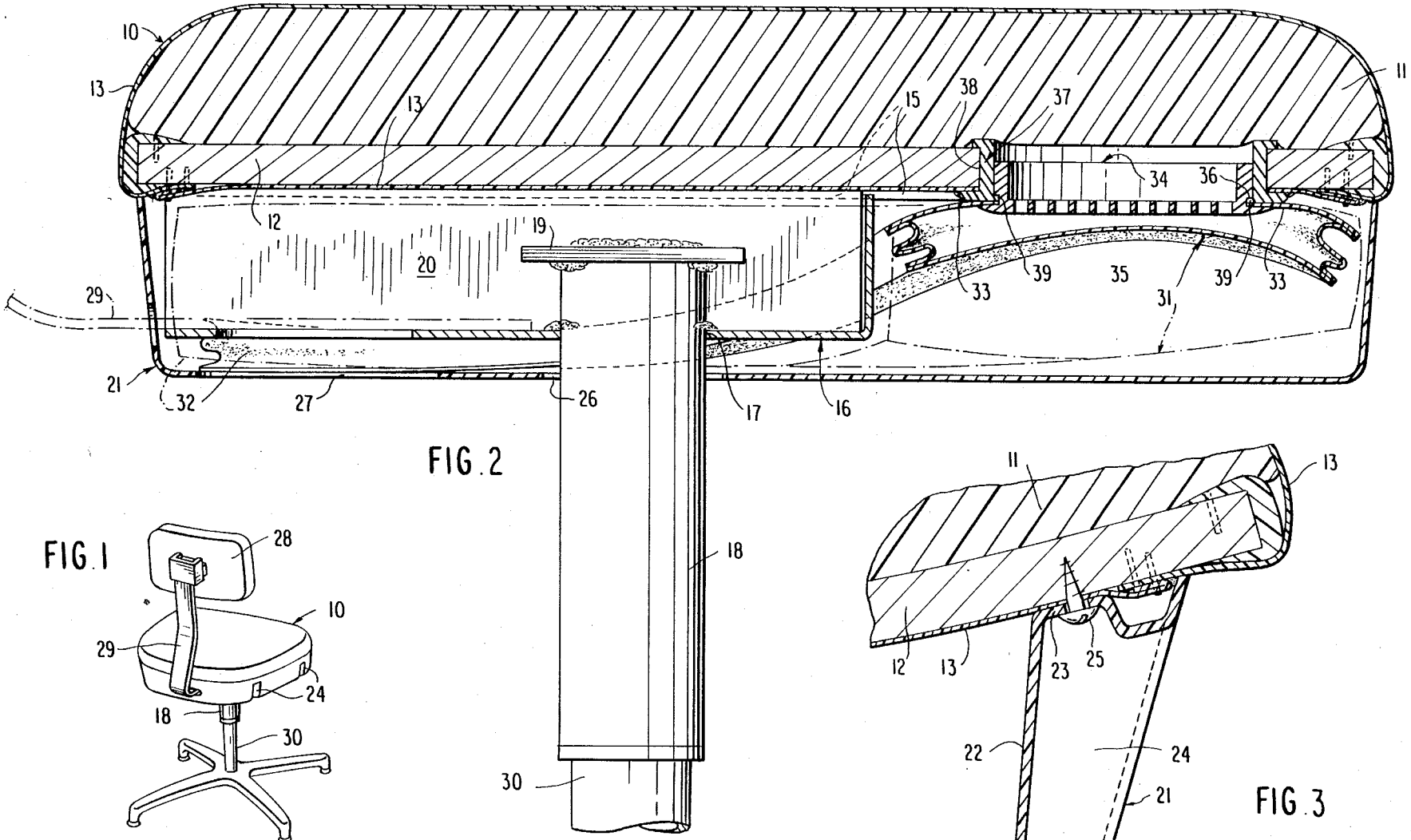
FIG. 1 is a perspective view of an upholstered clean room seat according to the present invention.
FIG. 2 is an enlarged central vertical section taken through the upholstered seat, seat pan and breather bag contained within the pan.
FIG. 3 is an enlarged fragmentary vertical section through the upholstered seat and seat pan showing a connection between a side inclined portion of the seat panel and the underlying pan.
Figure 4:
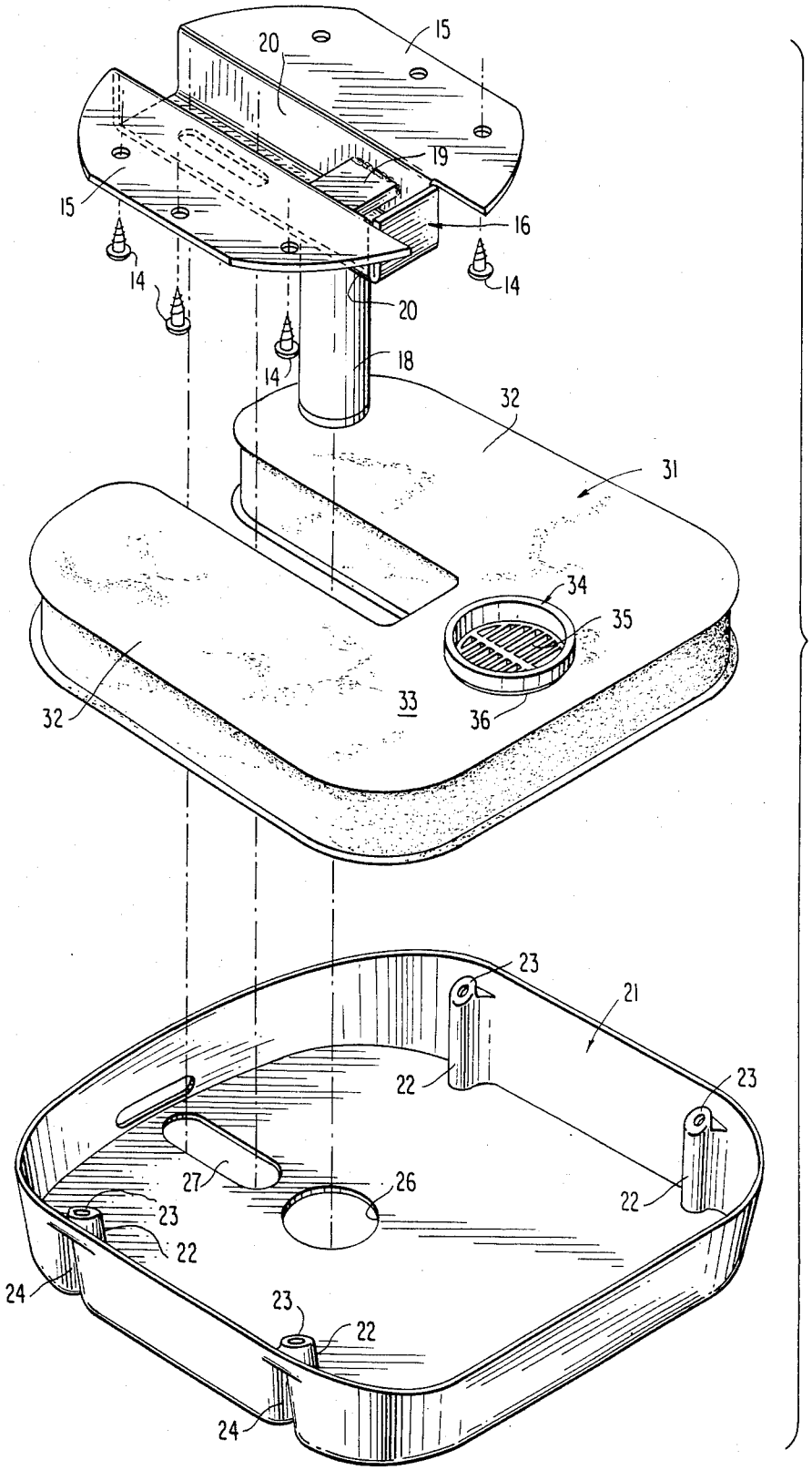
FIG. 4 is an exploded perspective view showing a standard and attached mounting bracket for the upholstered seat, the breather bag and pan.

Referring to the drawings in detail wherein like numerals designate like parts, the numeral 10 designates an hermetically sealed upholstered seat including a cushion 11 of foam rubber or the like, a substantially rigid bottom panel 12, and an airimpermeable flexible cover 13, preferably of sheet vinyl which encloses and seals the cushion 11 and rigid panel 12 substantially as shown and described in U.S. Pat. No. 4,573,740.

Toward its rear, the rigid panel 12 is attached by screws 14 to wide apertured flanges 15 of an elongated rigid channel box 16 having an opening 17 in its bottom wall receiving a tubular standard 18 having a rectangular head plate 19. The head plate 19 is welded to the side walls 20 of the channel box 16 and the standard 18 is welded to the bottom wall of the channel box 16 around the opening 17, as indicated in FIG. 2. The resulting construction is very rigid and strong.

Beneath the rigid panel 12 of the upholstered seat 10 is a relatively shallow pan 21 formed of molded polyethylene. The pan is lightweight and may have a wall thickness of about 0.125 inch.

Near its corners, the pan 21 is formed to provide four internal hollow bosses 22 having inclined apertured top walls 23 which abut similarly inclined side portions of the rigid panel 21 which is shaped to provide the desired contour for the upholstered seat. The outer sides of the hollow bosses 22 are open, as indicated at 24, to allow the placement of attaching screws 25 through the apertures of the top walls 23, as shown in FIG. 3. The pan 21 has a clearance opening 26 to receive the standard 18 and a slot 27 to allow the fore and aft adjustment of a back rest 28 having a resilient support arm 29 which extends into the channel box 16. The adjusting means for the arm 29 is entirely conventional and therefore has been omitted from the drawings for the sake of simplicity and need not be described.

The back rest 28 is upholstered and hermetically sealed to prevent the escape of particles into the clean room atmosphere during usage as described in U.S. Pat. No. 4,573,740. Since there is relatively slight compression of the back rest 28 by a chair occupant, it is unnecessary to equip the back rest with a breather or particle filtering means.

A conventional chair pedestal 30, FIG. 1, is coupled with the upholstered seat standard 18 in a conventional manner.

A very important feature comprising the essence of the present invention is the provision of a breather bag 31 formed of sheet vinyl having a preferred thickness of 20 mils. The breather bag is confined in and supported by the pan 21 and conforms to the shape of the pan and upholstered seat. It spans substantially the whole bottom surface of the seat panel 12 and is bifurcated at its rear to provide two portions or extensions 32 which straddle the channel box 16.

By making the breather bag 31 large in area, it can be quite shallow in depth and thus overcome one of the previouslystated drawbacks of the long slender bellows-type breather vessel employed in U.S. Pat. No. 4,573,740. The shallow breather bag 31 is fully concealed and is symmetrical in its relationship to the upholstered seat. When fully inflated, the breather bag is only $2\frac{1}{4}$ inches deep. When deflated, the breather bag 31 simply rests on the bottom wall of the pan 21. When fully inflated, the breather bag substantially fills the interior of the pan.

The top wall 33 of the breather bag 31 is equipped with a rubber connector sleeve 34 having a grille 35. The connector sleeve 34 has an external annular groove 36 which receives therein the apertured top wall 33 of the breather bag, such top wall being joined to the connector sleeve 34 with a sealant.

A coacting rubber grommet 37 is installed in an opening 38 of the rigid panel 12, using a sealant, and the grommet carries an internal annular bead 39 which interlocks within the annular groove 36 to form an effective self-sealing connection between the breather bag 31 and the interior of the upholstered seat 10.

As previously explained, the described system assures that all particulate matter will be retained within the hermetically sealed seat 10 and the breather bag 31 during normal usage of the clean room seat. In this respect, the functioning of the system is substantially as described in U.S. Pat. No. 4,573,740. When the cushion 11 is compressed, the air contained within it is expelled into the deflated breather bag 31, which then expands inside of the pan 21, as described. When the occupant leaves the seat 10 and the cushion 11 re-expands, the air within the breather bag 31 returns to the interior of the cushion 11 and all of this occurs without any release of particulate matter into the atmosphere, well within the requirements of the strict Federal standards which apply to industrial clean rooms.

The present invention offers definite improvements over the prior art in that the shallow breather bag 31 is concealed, is protected from damage, and is supported at all times by the pan 21. The pan itself, being shallow, eliminates possible interference with the feet and legs of the seat occupant. The overall appearance of the clean room seat according to this invention is vastly superior to the prior art.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

I claim:

1. An upholstered clean room seat comprising:

an hermetically sealed compressible and expandable seat body portion having a substantially rigid bottom panel, a standard including an attached mounting member secured to the rigid bottom panel, a pan underlying the rigid bottom panel and attached thereto, a breather bag contained within and supported by said pan, and a sealed coupling means between the breather bag and said seat body portion through which the interior of the breather bag and seat body portion are in communication.

2. An upholstered clean room seat as defined in claim 1, and the breather bag, pan and seat body portion being substantially coextensive in area.

3. An upholstered clean room seat as defined in claim 2, and the pan and breather bag when the breather bag is inflated having a depth not substantially exceeding the thickness of the seat body portion.

4. An upholstered clean room seat as defined in claim 3, and said attached mounting member of the standard comprising a flanged channel member within said pan near the rear of the pan and seat body portion, and said breather bag being bifurcated at its rear to provide spaced breather bag extensions which straddle said flanged channel member.

5. An upholstered clean room seat as defined in claim 4, and said flanged channel member including a pair of top substantially flat apertured flanges carried by opposite side walls of the channel member and being attachable to the bottom of said rigid bottom panel of the seat body portion.

6. An upholstered clean room seat as defined in claim 5, and said standard including a head plate disposed within the interior of said channel member and being welded to the side walls thereof, said standard being received through an opening in the bottom of the channel member and being welded to the bottom of the channel member around said opening.

7. An upholstered clean room seat as defined in claim 1, and said seat body portion comprising a cellular compressible cushion on the rigid bottom panel, and an air-impermeable flexible cover enclosing the seat body portion.

8. An upholstered clean room seat as defined in claim 1, and the sealed coupling means comprising a rubber-like coupling sleeve connected in a wall of the breather bag, a rubber-like grommet connected in an opening of the rigid bottom panel and receiving the coupling sleeve in its bore, and interengaging self-sealing means on the coupling sleeve and grommet.

9. An upholstered clean room seat as defined in claim 8, and the interengaging sealing means comprising an external annular groove in the coupling sleeve and an internal annular bead on the grommet engaging in said groove sealingly.

10. In an upholstered clean room seat:

an hermetically sealed compressible and expandable seat body portion having an air inlet and outlet passage means, a pan underlying the seat body portion and attached thereto, a breather bag within the pan and being supported by the pan while inflated and deflated, sealingly interengaged coupling means on the breather bag and seat body portion within said air inlet and outlet passage means, and support means connected with the seat body portion forming part of a pedestal structure for the clean room seat.

11. In a clean room seat, an upholstered compressible and expandable hermetically sealed seat body portion having an air inlet and outlet passage, a pan underlying and attached to the seat body portion, a breather bag disposed within said pan and being supported thereby below the seat body portion, and interengaged sealed coupling means on said breather bag and seat body portion within said air inlet and outlet passage.

* * * * *